US005870131A

United States Patent [19]

Yuge et al.

[11] Patent Number: 5,870,131

[45] Date of Patent: Feb. 9, 1999

[54] OPTICAL PRINTER AND PRINT HEAD THEREFOR

[75] Inventors: Tomohiko Yuge; Yukihiko Shimizu, both of Mobara, Japan

[73] Assignee: Futaba Denshi Kogyo K.K., Mobara, Japan

[21] Appl. No.: 667,631

[22] Filed: Jun. 21, 1996

[30] Foreign Application Priority Data

Jun. 22, 1995 [JP] Japan ..... 7-156233

[51] Int. Cl.[6] ..... B41J 2/435

[52] U.S. Cl. ..... 347/232; 347/256

[58] Field of Search ..... 347/232, 256, 347/257, 258, 241, 242

[56] References Cited

U.S. PATENT DOCUMENTS 4,240,729 12/1980 Barney ..... 354/76
4,804,978 2/1989 Tracy ..... 346/108
5,034,756 7/1991 Taira ..... 346/107
5,321,431 6/1994 Takeno ..... 346/108
5,592,205 1/1997 Shimizu et al. ..... 347/115

*Primary Examiner*—Safet Metjahic
*Assistant Examiner*—Christopher E. Mahoney
*Attorney, Agent, or Firm*—Oblon, Spivak, McClelland, Maier & Neustadt, P.C.

[57] ABSTRACT

An optical printer capable of being decreased in the number of parts, small-sized and weight. A plurality of color filters are selectively alternated or changed with each other with respect to a common luminous section and such changing-over among the filters is carried out using a transfer unit for a print head, resulting in only one set of the luminous section and optical system being required. Also, power required for alternating or changing the filters with each other Is obtained by the transfer unit for the print head without arranging any specific unit.

5 Claims, 7 Drawing Sheets

R,18
G
B
10
9
4
5
24
11
32
22
23
21
30
31
26
C2
C3
34
28
29
25
C1

OPTICAL PRINTER AND PRINT HEAD THEREFOR

BACKGROUND OF THE INVENTION

This invention relates to an optical printer suitable for use for, for example, a color video printer or the like, and more particularly to an optical printer wherein a plurality of filters are selectively alternated or changed with each other with respect to a common write source as desired.

One of optical printers which have been conventionally proposed is disclosed in Japanese Patent Application No. 276234/1991 by the assignee, which is constructed in such a manner as shown in FIG. 10. More particularly, the optical printer proposed includes a fluorescent luminous tube 100 acting as a write head. The fluorescent luminous tube 100 includes an envelope 103 constructed of a light-permeable substrate 101 and a casing 102 of a box-like shape scaledly joined to the substrate 101 and is evacuated to a high vacuum.

The substrate 101 is formed on an inner surface thereof with luminous sections each including an anode conductor and a phosphor layer deposited on the anode conductor. The phosphor layer is formed of a ZnO:Zn phosphor material. The luminous sections each are constituted by a plurality of luminous dots arranged at predetermined pitches in a main scanning direction. Three such luminous sections 200(R), 200(G) and 200(B) (200 (R, G, B)) are arranged in a sub-scanning direction.

The envelope 103 is provided therein with a Plurality of second control electrodes 104 so as to be positioned below the luminous sections 200 (R, G, B) and in a manner to be allotted to every luminous dot. The fluorescent luminous tube 100 also includes a common first control electrode 105 arranged below the second control electrodes 104 and formed in an electrically integral manner. Further, the fluorescent luminous tube 100 includes filamentary cathodes 106 arranged below the first control electrode 105 so as to extend in the main scanning direction for each of the luminous sections 200 (R, G, B).

The substrate 101 is provided on an outer surface thereof with a red filter r, a green filter g and a blue filter b in a manner to face the luminous sections R, G and B, resulting in three primary luminous colors of red, green and blue being taken out of the phosphor layers of the luminous sections. A luminous spectrum of the ZnO:Zn phosphor corresponds to a green color having not only a peak wavelength of 505 nm but a wide wavelength range between about 430 nm and 640 nm, so that use of the red, green and blue filters r, g and b permits the three primary luminous colors of red, green and blue to be taken out of the single phosphor.

The conventional optical printer also includes three lens systems 107 arranged adjacent to the filters r, g and b of the fluorescent luminous tube 100, respectively. Thus, light emitted from each of the luminous dots of the luminous sections 200 (R, G, B) is guided through each of the red, green and blue filters r, g and b to each of the lens systems 107, to thereby be focused at a predetermined position on a film 108 which is a written medium.

The print head thus including the fluorescent luminous tube 100 and lens systems 107 may be moved in the sub-scanning direction by means of a drive mechanism (not shown).

Driving of the optical printer thus constructed is carried out by scanning the luminous dots of the luminous sections 200 (R, G, B) of the fluorescent luminous tube 100 in order and applying a positive print signal to the second control electrodes 104 corresponding to the luminous sections in synchronism with the scanning. The first control electrode has a positive voltage constantly applied thereto to accelerate electrons emitted from the filamentary cathodes 106, thereby preventing any display defect due to application of a negative voltage to the second control electrodes 104 in correspondence to a non-luminous section.

The print head is moved in the sub-scanning direction indicated by an arrow in FIG. 10 in conformity with driving of the fluorescent luminous tube 100 for luminescence, to thereby focus light of each of the luminous colors at the same position on the film 108, resulting in a color image desired being formed on the film 108.

In the conventional optical printer described above which is so constructed that the filters r, g and b are securely provided on the luminous sections 200 (R, G, B) arranged in three lines to obtain light of each of the three primary colors, arrangement of the luminous sections in proximity to each other causes light emitted from each of the luminous sections to enter the filter of the luminous sections adjacent thereto, leading to color mixing. Thus, the conventional optical printer requires to increase intervals between the luminous sections to a degree sufficient to prevent the color mixing, resulting in failing in down-sizing thereof. Also, such an increase in interval between the luminous sections fails to permit light emitted from the three-line luminous sections to be satisfactorily formed into an image by means of only one optical system, so that it is required to separately arrange the optical system for every line. This renders down-sizing of the optical printer further difficult and causes an increase in manufacturing cost.

SUMMARY OF THE INVENTION

The present invention has been made in view of the foregoing disadvantage of the prior art.

Accordingly, it is an object of the present invention to provide an optical printer which is capable of being decreased in the number of parts, resulting in a size of the printer, a weight thereof and a cost thereof being significantly reduced.

It is another object of the present invention to provide a print head for an optical printer which is capable of reducing the number of parts of the optical printer.

In accordance with one aspect of the present invention, an optical printer for optical writing on a written medium is provided. The optical printer includes a print head which includes a write head provided with a luminous section and a plurality of filters arranged so as to be movable in a predetermined direction with respect to the write head and selectively set at the luminous section of the write head due to movement thereof in the predetermined direction. The optical printer also includes a transfer means for moving said print head in the predetermined direction and at least one abutment section abutted against the print head moved by the transfer means to move the filters in the predetermined direction, to thereby selectively set desired one of the filters at the write head.

In a preferred embodiment of the present invention, the abutment section is arranged at an end of a range of movement of the print head and the print head is provided with a reset mechanism for returning the filter moved to its original position.

In a preferred embodiment of the present invention, the abutment section is arranged at each of both ends of a range of movement of the print head and the filters are moved in directions opposite to each other when the print head is abutted against each of the abutment sections.

In a preferred embodiment of the present invention, the transfer means includes an endless elongated transfer body arranged so as to circularly movable in the predetermined direction and connected at a part thereof to the print head and a drive means for circularly moving the endless elongated transfer body.

In accordance with another aspect of the present invention, a print head for an optical printer which is adapted to carry out optical writing on a written medium while being moved in a predetermined direction by a transfer means is provided. The print head includes a base, a write head including a luminous section and provided on the base, and a plurality of filters arranged on the base so as to be movable in a predetermined direction with respect to the write head and moved due to abutment against a part of the optical printer during movement of the base in the predetermined direction by the transfer means, to thereby be selectively set at the luminous section of the write head..

In the present invention constructed as described above, the print head is moved in the predetermined direction by the transfer means, to thereby be abutted against the abutment. The filters are moved in the predetermined direction in the print head, so that one of the filters selected as desired is set at the luminous section of the write head. Thus, light emitted from the write head is permitted to pass through the selected filter selected, resulting in being written in a desired color on the written medium.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate like or corresponding parts throughout; wherein:

FIG. 2(*b*) is a sectional view taken along line B—B of FIG. 2(*a*);

DETAILED DESCRIPTION OF THE PREFERRED EMBODIMENTS

Figure 1:
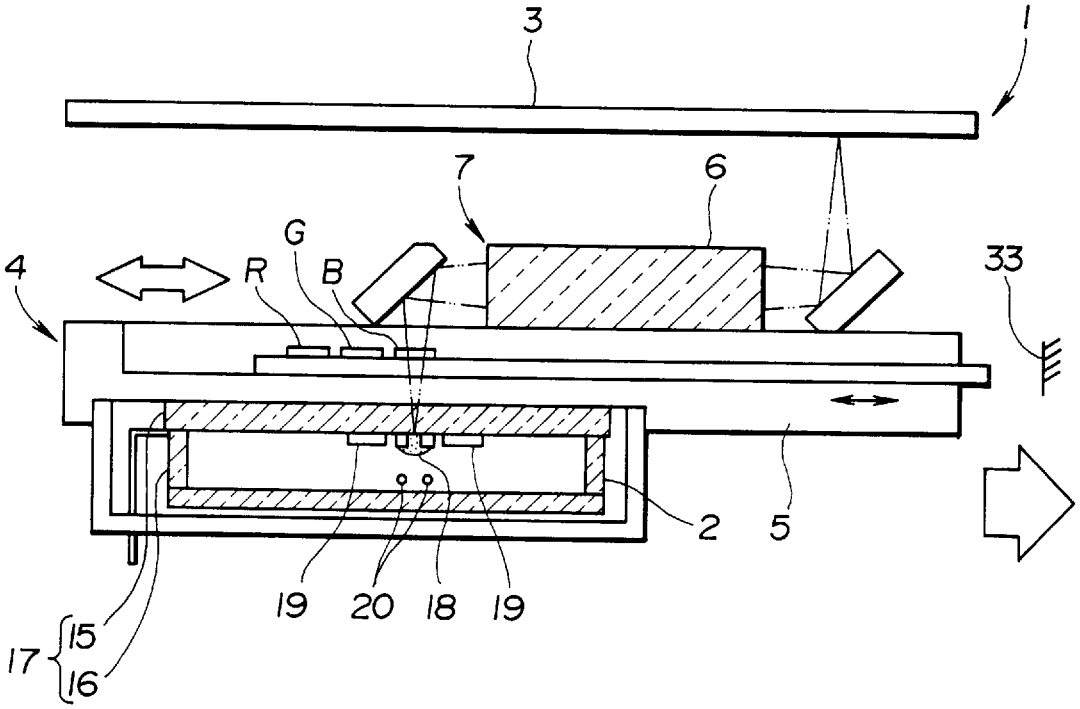
FIG. 1 is a sectional view schematically showing a print head incorporated in an embodiment of an optical printer according to the present invention.

Now, an optical printer according to the present invention and a print head therefor will be described hereinafter with reference to FIGS. 1 to 9.

Referring first to FIGS. 1 to 6, a first embodiment of an optical printer according to the present invention is illustrated. An optical printer of the illustrated embodiment which is generally designated at reference numeral 1 includes a fluorescent luminous tube 2 acting as a write head and three filters R, G and B arranged in a manner to be alternated or changed with each other as desired. The fluorescent luminous tube 2 and filters cooperate with each other to provide light of each of three primary colors. The light is then written on a color film 3 which is a written medium, to provide a full-color image. For example, the optical printer 1 may be used as a color video printer which is driven by a color image signal of a digital mode fed from a video unit to print a video image on the color film 3.

The optical printer 1 of the illustrated embodiment includes a print head 4 constructed as shown in FIG. 1. The print head 4 includes a base 5 moved in a sub-scanning direction indicated at arrows in FIG. 1 with respect to the color film 3 acting as a written medium. The base 5 is provided thereon with the fluorescent luminous tube 2 acting as a write head and the three filters R, G and B selectively alternated or changed with each other with respect to the fluorescent luminous tube 2 as desired, as well as a single optical system 7 including a lens 6 arranged so as to positionally correspond to the fluorescent luminous tube 2.

Figure 2A:
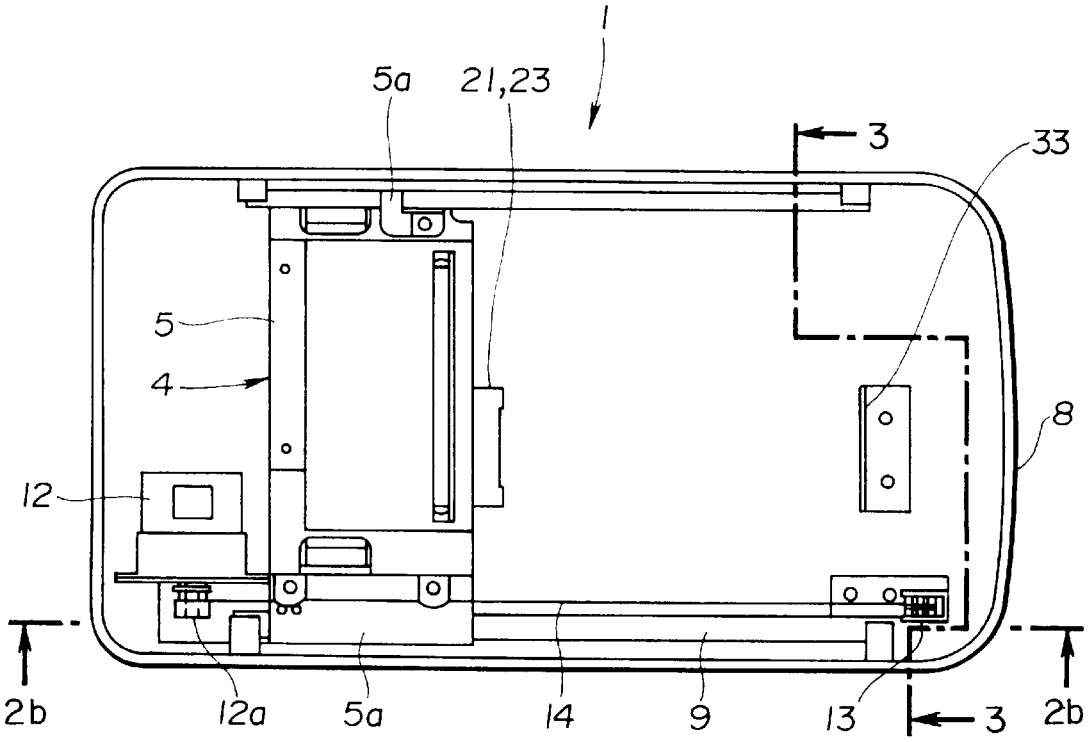
FIG. 2(*a*) is a plan view showing an embodiment of an optical printer according to the present invention.
Figure 2B:
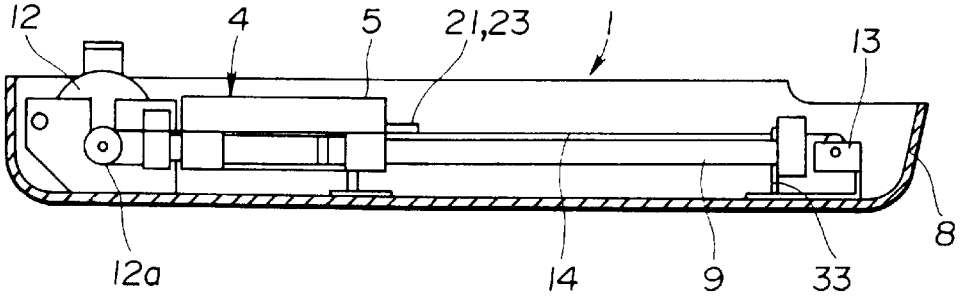
Figure 3:
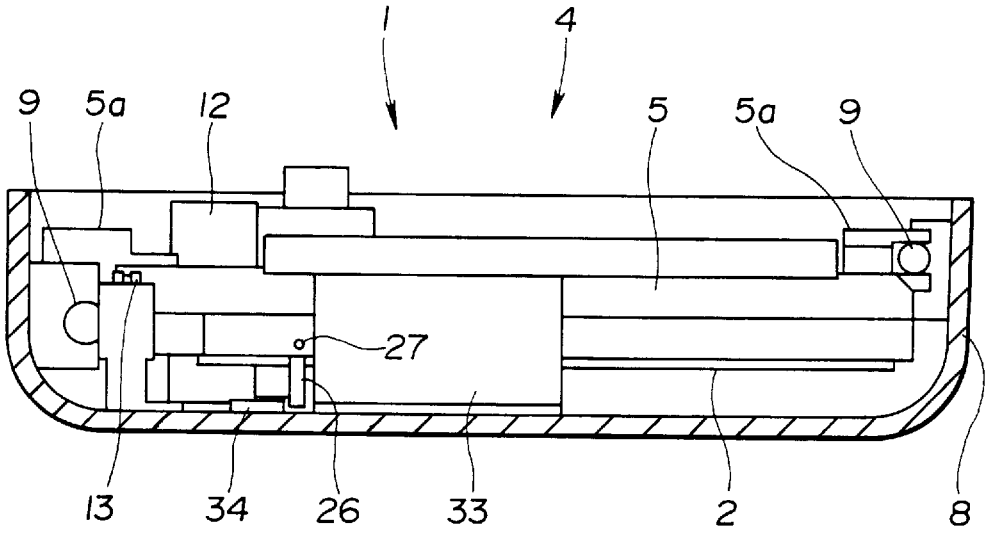
FIG. 3 is an enlarged sectional view taken along line A—A of FIG. 2(*a*)
Figures 4A, 4B, 4C:
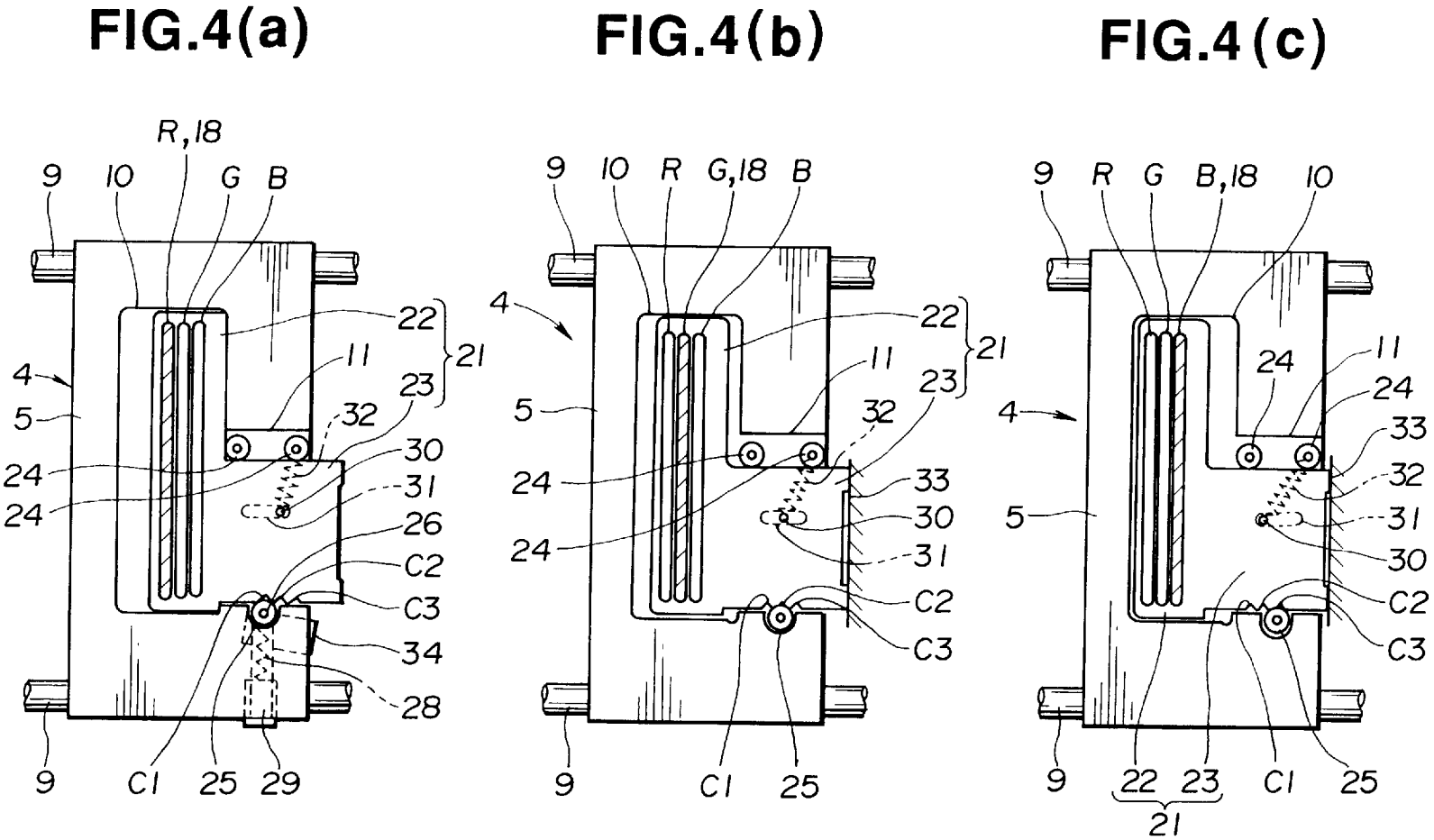
FIGS. 4(*a*) to 4(*c*) each are a plan view showing operation of the print head of FIG. 1.

The optical printer 1, as shown in FIGS. 2(*a*) and 2(*b*) and FIG. 3, includes a casing 8 which occupies a lower half of the optical printer 1. The lower half casing 8 is formed into a dish-like shape which is rectangular in plan. The casing 8 is provided therein with a pair of guide bars 9 in a manner to extend in parallel with each other along a pair of long sides of the casing 8. The base 5 comprises a plate-like member of a substantially rectangular shape and includes a pair of slide portions 5*a* which are arranged on a pair of short sides thereof and through which the guide bars 9 are slidably inserted, respectively. A direction in which the base 5 is moved along the guide bars 9 is defined so as to be parallel with the sub-scanning direction in which writing on the color film 3 is carried out by means of dot-like light. The base 5, as shown in FIGS. 4(*a*) to 4(*c*), is formed at a central portion thereof with a mounting hole 10 in a manner to pass therethrough. The mounting hole 10 is mounted therein with the fluorescent luminous tube 2 more detailedly described hereinafter or a filter holder 21 in a manner to be movable. The filter holder 21 will be detailedly described hereinafter. Also, the base 5 is formed with a guide groove 11 for guiding the filter holder 21 in a manner to be contiguous to the mounting hole 10 and extend to one end thereof defined in a direction of movement thereof.

The casing 8, as shown in FIGS. 2(*a*) to 3, is also provided therein with a motor 12 acting as a transfer means for base 5. The motor 12 is arranged in proximity to one end of one of the guide bars 9 beyond a range of movement of the base 5. The motor 12 includes a drive shaft arranged 80 as to be perpendicular to the guide bars 9, which is mounted thereon with a drive pulley 12*a*. Further, the casing 8 is rotatably mounted therein, with a driven pulley 13 through a jig in a manner to be positioned in proximity to the other end of the one guide bar 9 described above. The driven pulley 13 includes a revolving shaft arranged in parallel with the drive shaft of the motor 12. The drive pulley 12*a* and driven pulley 13 are operatively connected to each other through a drive belt 14 wound thereon. The drive belt 14 is fixed at a part of an upper side thereof on an upper surface portion of one of the slide portions of the base 5 or the slide portion 5*a*. When the motor 12 is driven to circulatedly operate the drive belt 14, the base 5 formed on the drive belt 14 is moved in the sub-scanning direction while being guided by the guide bars 9.

Figure 5:
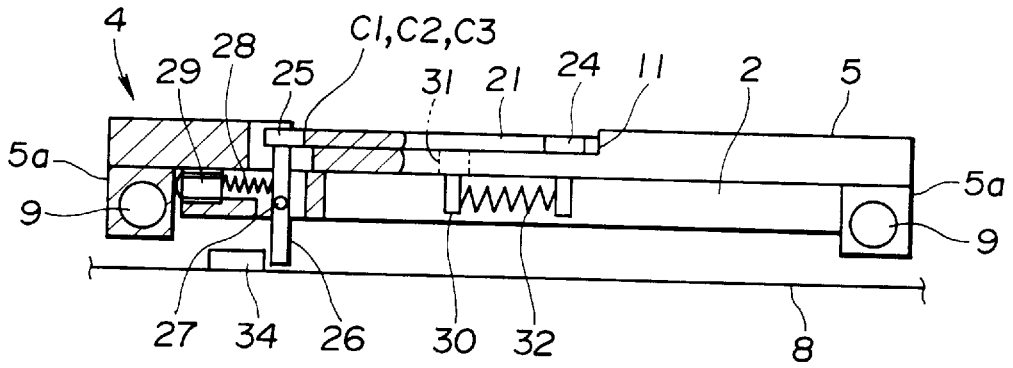
FIG. 5 is a sectional view of the print head shown in FIG. 1.

The base 5, as shown in FIGS. 1, 3 and 5, is mounted thereon with the fluorescent luminous tube 2 acting as the write head, which has been described briefly. The fluorescent luminous tube 2, as shown in FIG. 1, includes an envelope 17 of a substantially rectangular parallelepiped formed by sealedly joining a light-permeable rectangular substrate 15 and a box-like casing 16 to each other and evacuated to a high vacuum. The casing 16 is provided thereon with a shielding film for keeping external light from entering the casing 16, to thereby prevent flare.

The substrate 15, as shown in FIG. 1, is formed on an inner surface thereof with a luminous section 18 constructed of a number of luminous dots arranged in a row in a longitudinal direction thereof. The luminous dots which constitute the luminous section 18 include dot-like anode conductors arranged in a row on the substrate 15 and phosphor layers respectively deposited on the anode conductors. The anode conductors of the luminous dots are led out of the envelope separately from each other and have a drive signal applied thereto separately from each other, resulting in static driving thereof being possible. The phosphor layer of each of the luminous dots is made of a ZnO:Zn phosphor material. The ZnO:Zn phosphor has a luminous spectrum extending over a highly wide range, so that use of the red, green and blue filters R, G and B permits light of each of three primary colors to be obtained from luminescence of the phosphor. A direction in which the luminous dots are juxtaposed to each other in the luminous section 18 is defined so as to be parallel to a main scanning direction in which writing is carried out on the color film 3 by means of dot-like light.

The substrate 15 thus arranged in the envelope 17 is provided on portions thereof positioned on both sides of the luminous section 18 with strip-like plane control electrodes 19, which are made of a thin film of aluminum or the like. During driving of the fluorescent luminous tube 2, the plane control electrodes 19 have a positive voltage applied thereto to permit electrons to be attracted to the luminous section 18. The envelope 17 is provided therein with filamentary cathodes 20 acting as an electron source in a manner to extend in the main scanning direction below the luminous section 18.

The fluorescent luminous tube 2 thus constructed is mounted in the mounting hole 10 of the base 5 from a side of the casing 8 while keeping the substrate 15 which is provided thereon with the luminous section 18 facing the base 5.

The base 5, as shown in FIGS. 2, 4 and 5, is provided thereon with the filter holder 21 briefly described above in a manner to be movable in the sub-scanning direction with respect to the fluorescent luminous tube 2. The filter holder 21 includes a holder body 22 of a rectangular shape slidably fitted in the mounting hole 10 of the base 5 and an abutting member 23 of a rectangular shape engaged in the guide groove 11 of the base 5. The holder body 22 and abutting member 23 are formed integrally with each other, so that the holder body 22 is generally formed into a substantially L-shape. The filter holder 21 is arranged so as to be movable in the sub-scanning direction with respect to the mounting hole 10 of the base 5 and the guide groove 11.

The guide groove 11 of the base 5, as shown in FIGS. 4 and 5, is provided on one of edges thereof with a pair of fixed bearings 24 in a manner to be rotatable at a predetermined position, to thereby act as a guide means. The guide groove 11 of the base 5 is provided on the other edge thereof opposite to the bearings 24 with a movable bearing 25 also acting as a guide means. The movable bearing 25 is mounted on an upper end of a support shaft 26. The support shaft 26 is mounted at an intermediate portion thereof on the base 5 by means of a pin 27, resulting in being pivotable within a predetermined rotational angle range in a plane parallel to the main scanning direction. The support shaft 26 has a lower end downwardly projected from a lower surface of the base 5. The base 5 is provided therein with a spring 28 acting as a bias means, which is held in the base 5 by means of a holding screw 29, so that a portion of the support shaft 26 which is defined above the pin 27 and on which the movable bearing 25 is arranged is urged or forced toward the filter holder 21.

The abutting member 23 of the filter holder 21 is guided in the sub-scanning direction while being interposed between the fixed bearings 24 and the movable bearing 25 arranged in the guide groove 11 of the base 5. The abutting member 23 is provided on a lower surface thereof with a projection 30. The projection 30 is arranged so as to be inserted through an elongated through-hole 31 formed at the guide groove 11 of the base 5, to thereby be downwardly projected from the lower surface of the base 5. Between a lower end of the projection 30 downwardly projected from the base 5 through the elongated through-hole 31 and a pin of each of the fixed bearings 24 is arranged a spring 32 acting as a bias means. The spring 32 functions to force the filter holder 21 so that the abutting member 23 is outwardly projected from the guide groove 11. The abutting member 23 is formed at an edge portion thereof facing the movable bearing 25 with three cutouts C1, C2 and C3. The movable bearing 25 is selectively engaged with any one of the cutouts C1, C2 and C3, so that the filter holder 21 may be selectively set at any one of three positions with respect to the base 5.

The holder body 22 of the filter holder 21 is formed with three grooves so as to extend therethrough in a direction parallel to the main scanning direction. The grooves are mounted therein with the red filter R, green filter G and blue filter B, respectively. The filters R, G and B or grooves are arranged so as to be spaced from each other in the sub-scanning direction at intervals corresponding to those among the cutouts C1, C2 and C3. The filters R, G and B are formed so as to be identical in length and direction with the luminous section 18 of the fluorescent luminous tube 2. The filters R, G and B and the luminous section 18 of the fluorescent luminous tube 2 are adapted to be positionally coincident with each other at three positions at which the filter holder 21 is selectively set.

The dish-like lower half casing 8, as shown in FIGS. 2 to 4, is provided on a predetermined position of an inner bottom thereof with an abutment 33 which is adapted to be abutted against the abutting member 23 of the print head 4 being moved. In the illustrated embodiment, the abutment 33 is constructed of a metal plate member of a substantially L-shape formed separately from the casing 8. When the base 5 of the print head 4 is moved to abut the abutting member 23 of the filter holder 21 against the abutment 33, the filter holder 21 is moved in the sub-scanning direction with respect to the base 5, so that desired one of the filters R, G and B may be positioned at the luminous section 18 of the fluorescent luminous tube 2.

Also, the lower half casing 8, as shown in FIGS. 3 to 5, is provided on another predetermined position of the inner bottom thereof with a holding member 34 engaged with the lower end of the support shaft 26 of the movable bearing 25 of the print head 4 being moved. In the illustrated embodiment, the holding member 34 is constructed of a metal plate member formed separately from the casing 8.

When the base 5 of the print head 4 is moved in a direction apart from the abutment 33 to engage the support shaft 26 of the movable bearing 25 with the holding member 34, the support shaft 26 is pivotally moved about the pin 27, so that the movable bearing 25 is released from the cutouts C1, C2 and C3 of the filter holder 21. This results in the filter holder 21 being moved toward the abutment 33 by elastic force of the spring 32, to thereby cause the movable bearing 25 being engaged with the cutout C1 arranged at a position farthest apart from the abutment 33. In the illustrated embodiment, the position is referred to as a reset position. At the reset position shown in FIG. 4(*a*), the red filter R is set at the luminous section 18 of the fluorescent luminous tube 2.

The lower half casing 8 shown in FIG. 2 and 3 is combined with an upper half casing (not shown) provided with a storage holder for the color film 3. The storage holder for the color film 3 is adapted to hold a plurality of the color films 3 charged therein at a predetermined position and includes a mechanism for outwardly discharging the color film 3 on which writing by light has been carried out out.

Now, formation of a full-color image on the color film 3 by means of the optical printer 1 of the illustrated embodiment thus constructed will be described hereinafter.

The fluorescent luminous tube 2 is driven depending on each of image signals of an image which has been subject to color separation into the three primary colors and the print head 4 is moved in the sub-scanning direction in synchronism with the driving. At this time, the filter R, G or B for each of the three primary colors corresponding to the drive signal is set at the luminous section 18 of the fluorescent luminous tube 2 of the print head 4. Such operation is carried out for each of the three primary colors, so that one of the three images which have been subject to color separation into the three primary colors are written on a sensitive surface of the single color film 3 while being superposed on each other.

Figure 6:
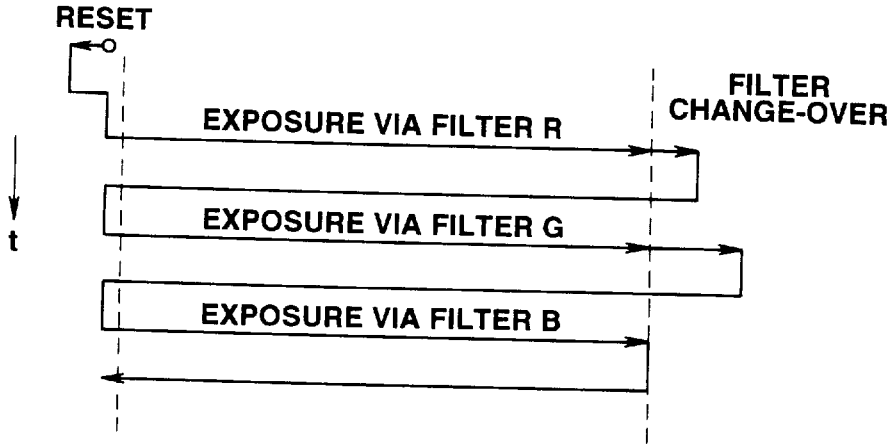
FIG. 6 is a diagrammatic view showing movement of the print head of FIG. 1.

At the time of starting of the above-described operation, "reset" operation shown in FIG. 6 is first carried out irrespective of a position of the print head 4, so that movement and setting of the print head 4 are carried out at a position at which the filter holder 21 is reset. More particularly, as shown in FIG. 4(*a*), the print head 4 is first set at a position farthest from the abutment 33 within a range of movement thereof (hereinafter referred to as ("start position") The support shaft 26 of the print head 4 is engaged with the holding member 34, to thereby be pivotally moved about the pin 27, so that the movable bearing 25 is released from the cutout C2 or C3. The filter holder 21 is set at a reset position by the spring 32, so that the red filter R is set at the luminous section 18 of the fluorescent luminous tube 2. As shown in FIG. 6, the fluorescent luminous tube 2 is driven by a drive signal corresponding to a red image while moving the print head 4 toward the abutment 33 in the sub-scanning direction, so that the color film 3 is subject to exposure through the red filter R.

After such exposure through the red filter R is completed, the print head 4, as shown in FIG. 6, is further moved by a distance corresponding to intervals among the cutouts C1, C2 and C3 toward the abutment 33, so that the filter holder 21 is abutted against the abutment 33, to thereby be moved in the sub-scanning direction with respect to the base 5, resulting in the movable bearing 25 being engaged with the cutout C2, so that the green filter G is set at the luminous section 18 of the fluorescent luminous tube 2. Subsequently, the print head 4 is returned to the start position and then move toward the abutment 33 in the sub-scanning direction, during which the fluorescent luminous tube 2 is driven by a drive signal corresponding to a green image, so that the color film 3 is exposed through the green filter G.

After the exposure through the green filter G is carried out, the print head 4 is further moved by a distance twice as long as the intervals among the cutouts C1, C2 and C3 toward the abutment 33 as shown in FIG. 6, so that the filter holder 21 is abutted against the abutment 33, to thereby be moved in the sub-scanning direction with respect to the base 5, resulting in the movable bearing 25 being engaged with the cutout C3, so that the blue filter B is set at the luminous section 18 of the fluorescent luminous tube 2. Thereafter, the print head 4 is returned to the start position and then the print head 4 is moved toward the abutment 33 in the sub-scanning direction, during which the fluorescent luminous tube 2 is driven by a drive signal corresponding to a blue image, so that the color film 3 is subject to exposure through the blue filter B.

The above-described operation permits a full-color latent image to be formed on the color film 3.

The optical printer I of the illustrated embodiment, as described above, is so constructed that the three filters R, G and B are selectively alternated or changed with each other with respect to the single luminous section 18 of the fluorescent luminous tube 2 as desired and such selective alternation or changing-over among the filters R, G and B is carried out by drive force of the transfer mechanism of the print head 4. Such construction eliminates a necessity of arranging the luminous section 18 for each of the three primary colors, leading to down-sizing of the fluorescent luminous tube 2. Also, it does not require any specific or separate drive mechanism for changing-over among the filters R, G and B, resulting in the number of optical systems 7 required being only one.

Figure 7:
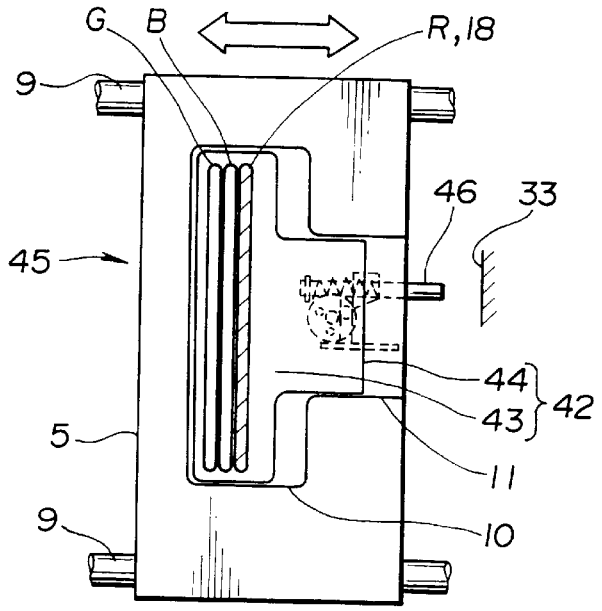
FIG. 7 is a plan view showing a print head incorporated in another embodiment of an optical printer according to the present invention and operation thereof.
Figure 8:
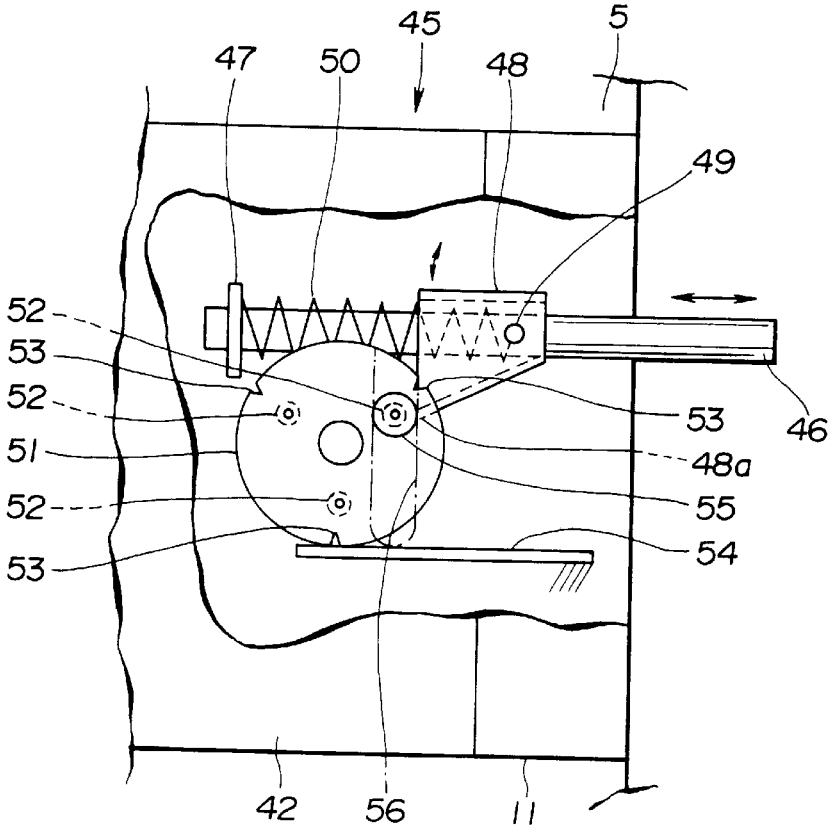
FIG. 8 is fragmentary plan view showing a transfer mechanism for a filter holder of the print head of FIG. 7.
Figure 9:
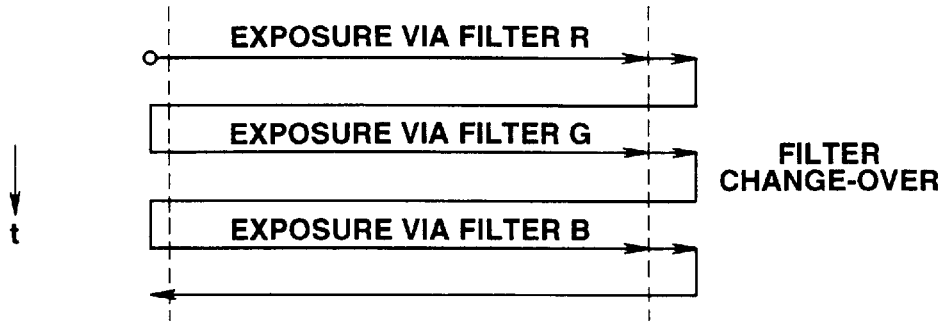
FIG. 9 is a diagrammatic view showing movement of the print head of FIG. 8.
Figure 10:
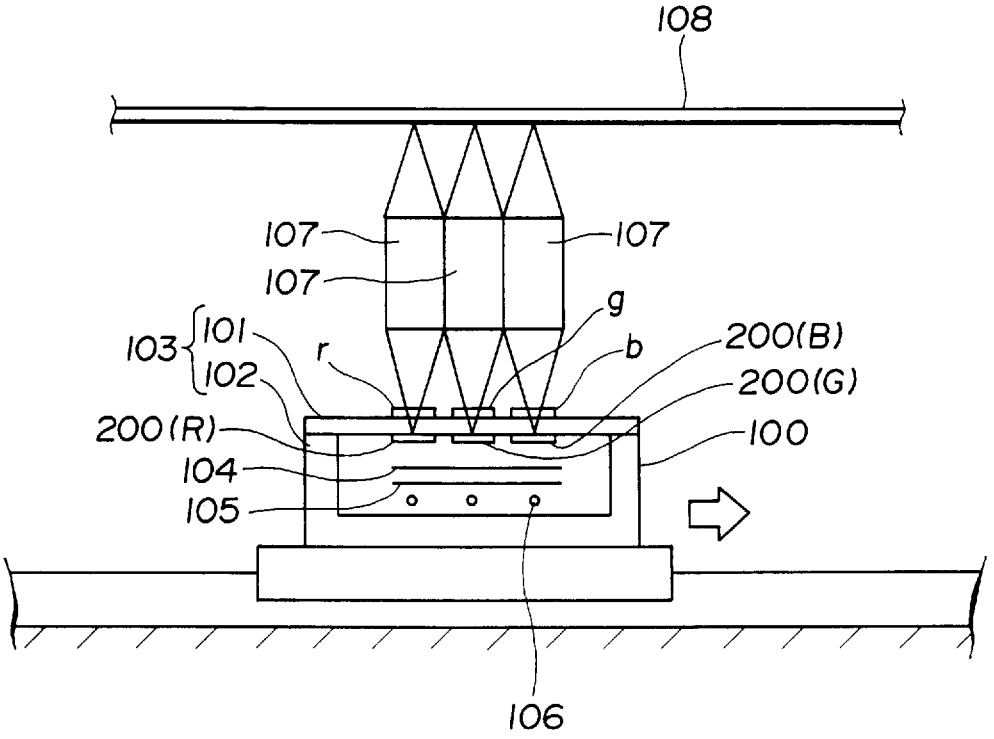
FIG.10 PRIOR ART
FIG. 10 is a schematic view showing a conventional optical printer.

Referring now to FIGS. 7 to 9, a second embodiment of an optical printer according to the present invention is illustrated. An optical printer of the second embodiment which is generally designated at reference numeral 41 is constructed in substantially the same manner as the first embodiment described above, except a change-over mechanism for a filter holder.

In the second embodiment, a filter holder 42, as shown in FIG. 7, is constructed of a holder body 43 and an abutting section 44 into a substantially T-shape. The abutting section 44 is provided with a ratchet mechanism for selectively Betting three filters R, G and B at a luminous section 18 of a fluorescent luminous tube 2.

A base 5 of a print head 45 is provided thereon with a bar-like operation element 46 in a manner to be movable in a sub-scanning direction, The operation element 46 is so arranged that one end thereof faces an abutment 33 arranged outside the base 5. The operation element 46 has the other end inserted through a spring holder 47 provided on the base 5. The operation element 46 is fitted on a substantially intermediate portion thereof with a holder 48 of a rectangular cylindrical shape which is open at both upper and lower ends thereof, which is pivotally connected to the operation element 46 through a pin 49. The holder 48 is so formed that one of halves thereof defined about an axis of the operation element 46 is projected, to thereby act as a holding pawl 48*a*. The operation element 46 is also fitted on a portion thereof between the pin 49 of the holder 48 and the spring holder 47 with a spring 50.

The base 5 is rotatably mounted thereon with a ratchet wheel 51 through a support shaft. The ratchet wheel 51 is mounted on a lower surface thereof with downwardly extending holding pins 52 at angular intervals of 120 degrees in a rotational direction thereof. The holding pins 52 are engaged with the holding pawl 48*a* of the holder 48 with movement of the operation element 46. The ratchet wheel 51 is formed on an outer periphery thereof with cutouts 53 so as to positionally correspond to the cutouts 53. Reference numeral 54 designates a leaf spring which is fixed at one end thereof on the base 5. The leaf spring 54 is so arranged that the other end thereof is contacted with the periphery of the ratchet wheel 51, to thereby be engaged with each of the cutouts 53. The ratchet wheel 51 is mounted on an upper surface thereof with an upwardly extending guide pin 55 so as to positionally correspond to one of the three holding pins 52. The filter holder 42 is provided with a hole 56, which is arranged so as to be elongated in a main scanning direction. The guide pin 55 is engagedly fitted in the elongated hole 56.

In the optical printer of the second embodiment thus constructed, when the print heat 4 is moved in the sub-scanning direction to abut the operation element 46 against the abutment 33, the operation element 46 is forced against elastic force of the spring 50, so that the holding pawl 48*a* of the holder 48 is engaged with the holding pin 52 of the ratchet wheel 51 to rotate the ratchet wheel 51 by one stroke (120 degrees), so that the leaf spring 54 is engaged with the next cutout 53 to fix the ratchet wheel 51 set at a new position. The filter holder 42 operatively connected to the guide pin 55 of the ratchet wheel 51 is moved in the sub-scanning direction with respect to the base 5, so that the filter R, G or B set at the luminous section 18 of the fluorescent luminous tube 2 is alternated or changed with another one. Thereafter, the operation element 46 is returned to its original position. This is smoothly carried out without being caught by the holding pin 51 of the ratchet wheel 51 because the holding element 48 is pivotally moved about the pin 49.

In the second embodiment, a position of the filter holder 42 is changed over successively with rotation of the ratchet wheel 51, so that it is not required to carry out reset operation at the time of start of operation as in the first embodiment. More particularly, the second embodiment, as shown in FIG. 9, is so constructed that a stroke by which the print stroke 45 is moved for changing-over among the filters R, G and B after exposure through one of the filters is kept constant. Repeating of the movement by the same or constant stroke causes a position of the filter holder 42 to be successively changed over, so that reciprocation carried out out three times leads to returning to the initial red filter R.

In each of the embodiments described above, the fluorescent luminous tube 2 is used as the write head. However, the present invention permits any suitable luminous element to be used as the write head irrespective of its luminous principle.

Also, when the fluorescent luminous tube is used for this purpose, an internal electrode structure therefor is not limited to that in each of the above-described embodiments. For example, the luminous section 18 acting as an anode is not limited to arrangement of the luminous dots in a row. The luminous dots may be arranged in an offset manner, resulting in being driven at predetermined timings for luminescence to obtain dot-like light in a row. Alternatively, the luminous dots may be arranged in three rows or more while being deviated by dot pitches in a longitudinal direction of the rows. Also, the electron emission section is not limited to the filamentary cathodes. It may be constructed of field emission cathodes.

Also, in each of the embodiments described above, the transfer means for moving the print head 4 or 45 is constituted by the motor 12 and the drive belt 14 driven by the motor 12. Alternatively, the transfer means may comprise a combination of a power source and a power transmission mechanism each constructed in another way. In the present invention, it is not necessarily required to arrange the transfer means outside the print head 4 or 45. Alternatively, the print head may be provided thereon with a crawler mechanism acting as the transfer means.

Further, in each of the embodiments described above, changing-over among the filters R, G and B is carried out by moving the print head 4 or 45 to abut a part of the filter holder 21 or 42 against the abutment 33. However, it is not necessarily required to provide the abutment 33 separately from the casing 8 and the like. In the present invention, it is merely required to contact the abutment with at least a part of the filter holder 21 or 42 being moved to move the filter holder 21 or 42 with respect to the base 5. For example, the casing 8 may be so constructed that a part thereof exhibits the same function as the abutment 33.

Moreover, in each of the embodiments described above, the abutment 33 is provided on one side in the direction of movement of the print head 4 or 45. Alternatively, the abutment 33 may be arranged on each of both sides in the direction, so that a direction of changing-over among the filters due to abutment against one abutment is opposite to that due to abutment against the other abutment.

Furthermore, in each of the embodiments described above, writing is carried out on the color film 3. However, a written medium is not limited to the color film. Any suitable record medium on which optical recording can be accomplished may be used for this purpose.

In addition, in each of the embodiments described above, the red, green and blue filters R, G and B are arranged for exposure of the color film 3 to the three primary colors. However, a type of the filters may be selected depending on a kind of the written medium and properties thereof, as well as characteristics of light emitted from the write head as desired. For example, a color film is varied in spectral sensitivity depending on a type thereof, a manufacturer thereof or the like. In such a case, a plurality of filters of the same color which are previously provided may be selectively used depending on a spectral sensitivity of a color film used.

Also, the present invention may be so constructed that the filter holder is changed over at four positions or more and provided with an open window for inspection in addition to the filters R, G and B. Also, the write head may be fully shielded at a part of the change-over positions, so that the position may be used for preventing fog of the film due to luminescence of the write head.

As can be seen from the foregoing, the optical printer of the present Invention is so constructed that a plurality of the filters are selectively alternated or changed with each other with respect to the common luminous section and such changing-over among the filters is carried out using the transfer means for the print head, resulting in only one set of the luminous section and optical system being required, leading to small-sizing and weight-saving of the print head. This permits both small-sizing of the drive source for the transfer means used for the print head and power saving. Also, power for changing-over among the filters is obtained by the transfer means for the print head, so that such advantages may be accomplished without any additional parts or mechanism. Thus, it will be noted that the present invention provides an optical printer decreased in the number of parts, weight and cost, as well as a printer head for the optical printer.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An optical printer for optical writing on a written medium comprising:

a print head including a write head provided with a luminous section, and a plurality of filters arranged to as to be movable in a predetermined direction with respect to said write head, each of said filters being selectively set at said luminous section of said write head due to movement of said filters in the predetermined direction;

a transfer means for moving said print head in said predetermined direction;

a spring urging an element of said filters to project from the print head;

means for selectively positioning said filters in one of three positions having different degrees of projection of said element from the print head; and at least one abutment section abutted against said element of said filters moved by said transfer means to move said filters in said predetermined direction between said three positions, to thereby selectively set a desired one of said filters at said write head.

2. An optical printer as defined in claim 1, wherein said abutment section is arranged at an end of a range of movement of said print head; and said print head is provided with a reset mechanism for returning said filter moved to its original position.

3. An optical printer as defined in claim 1, wherein said abutment section is arranged at each of both ends of a range of movement of said print head; and said filters are moved in directions opposite to each other when said print head is abutted against each of said abutment sections.

4. An optical printer as defined in claim 1, wherein said transfer means includes an endless elongated transfer body arranged so as to be circularly movable in said predetermined direction and connected at a part of said transfer body to said print head and a drive means for circularly moving said endless elongated transfer body.

5. A print head for an optical printer which is adapted to carry out optical writing on a written medium while being moved in a predetermined direction by a transfer means, comprising:

a base;

a write head including a luminous section and provided on said base;

a plurality of filters arranged on said base so as to be movable in a predetermined direction with respect to said write head, a spring urging an element of said filters to project from the base;

means for selectively positioning said filters in one of three positions having different degrees of projection of said element from the base, the filters being moved between the three positions due to abutment against a part of said optical printer during movement of said base in said predetermined direction by said transfer means, to thereby be selectively set at said luminous section of said write head.

* * * * *